US009469823B2

(12) United States Patent
Gieselman et al.

(10) Patent No.: US 9,469,823 B2
(45) Date of Patent: Oct. 18, 2016

(54) COMPOSITION CONTAINING ESTER COMPOUNDS AND A METHOD OF LUBRICATING AN INTERNAL COMBUSTION ENGINE

(71) Applicant: The Lubrizol Corporation, Wickliffe, OH (US)

(72) Inventors: Matthew D. Gieselman, Wickliffe, OH (US); Jody A. Kocsis, Chagrin Falls, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/536,718

(22) Filed: Nov. 10, 2014

(65) Prior Publication Data

US 2015/0065406 A1 Mar. 5, 2015

Related U.S. Application Data

(63) Continuation of application No. 13/201,895, filed as application No. PCT/US2010/023274 on Feb. 5, 2010, now Pat. No. 8,921,288.

(60) Provisional application No. 61/153,403, filed on Feb. 18, 2009.

(51) Int. Cl.

| | |
|---|---|
| ***C10M 129/68*** | (2006.01) |
| ***C10M 129/70*** | (2006.01) |
| ***C10M 133/08*** | (2006.01) |
| ***C10M 133/06*** | (2006.01) |
| ***C10M 133/16*** | (2006.01) |
| ***C10M 163/00*** | (2006.01) |

(52) U.S. Cl.

CPC ..... *C10M 133/08* (2013.01); *C10M 133/06* (2013.01); *C10M 133/16* (2013.01); *C10M 163/00* (2013.01); *C10M 2207/028* (2013.01); *C10M 2207/24* (2013.01); *C10M 2207/26* (2013.01); *C10M 2207/262* (2013.01); *C10M 2207/281* (2013.01); *C10M 2207/282* (2013.01); *C10M 2207/289* (2013.01); *C10M 2215/08* (2013.01); *C10M 2215/086* (2013.01); *C10M 2215/224* (2013.01); *C10M 2219/046* (2013.01); *C10M 2219/068* (2013.01); *C10M 2223/045* (2013.01); *C10M 2223/049* (2013.01); *C10M 2227/066* (2013.01); *C10N 2210/06* (2013.01); *C10N 2230/06* (2013.01); *C10N 2230/12* (2013.01); *C10N 2230/40* (2013.01); *C10N 2230/42* (2013.01); *C10N 2230/43* (2013.01); *C10N 2230/45* (2013.01); *C10N 2240/10* (2013.01)

(58) Field of Classification Search

CPC ..... C10M 129/68; C10M 129/70; C10M 2207/28

USPC ..... 508/476, 500

See application file for complete search history.

(56) References Cited

U.S. PATENT DOCUMENTS

| | | | | |
|---|---|---|---|---|
| 3,896,050 | A | 7/1975 | White et al. | |
| 3,966,623 | A | 6/1976 | Krug et al. | |
| 4,012,408 | A | 3/1977 | White et al. | |
| 5,069,806 | A | 12/1991 | Trivett et al. | |
| 5,234,612 | A * | 8/1993 | Carlisle | C08G 65/33303 508/476 |
| 5,320,768 | A | 6/1994 | Gutierrez et al. | |
| 7,026,273 | B2 * | 4/2006 | Robson | C10M 141/12 508/156 |
| 7,651,987 | B2 * | 1/2010 | Kocsis | C10M 129/72 508/506 |
| 7,807,611 | B2 * | 10/2010 | Kocsis | C10M 129/72 508/506 |
| 8,921,288 | B2 * | 12/2014 | Gieselman | C10M 133/06 508/476 |
| 2004/0038835 | A1 | 2/2004 | Chasan et al. | |

FOREIGN PATENT DOCUMENTS

| | | |
|---|---|---|
| EP | 1642954 | 4/2006 |
| WO | 2004/026811 | 4/2004 |
| WO | 2008/074760 | 6/2008 |
| WO | 2008/147701 | 12/2008 |
| WO | 2009/074667 | 6/2009 |

* cited by examiner

*Primary Examiner* — Ellen McAvoy

(74) *Attorney, Agent, or Firm* — David M. Shold; Tersan W. Gilbert

(57) ABSTRACT

The invention provides a lubricating composition containing a β-amino compound. The invention further relates to a method of lubricating an internal combustion engine by lubricating the engine with the lubricating composition. The invention further relates to the use of the β-amino carbonyl compound as copper corrosion inhibitors, friction control agents, antiwear and/or extreme pressure agents.

18 Claims, No Drawings

COMPOSITION CONTAINING ESTER COMPOUNDS AND A METHOD OF LUBRICATING AN INTERNAL COMBUSTION ENGINE

FIELD OF INVENTION

The invention provides a lubricating composition containing a β-amino compound. The invention further relates to a method of lubricating an internal combustion engine by lubricating the engine with the lubricating composition. The invention further relates to the use of the β-amino carbonyl compound as a copper corrosion inhibitor, a friction control agent, an antiwear agent and/or an extreme pressure agent.

BACKGROUND OF THE INVENTION

It is well known for lubricating oils to contain a number of surface active additives (including antiwear agents, dispersants, or detergents) used to protect internal combustion engines from wear, soot deposits and acid build up. Often, such surface active additives can have harmful effects on bearing corrosion or fuel economy. A common antiwear additive for engine lubricating oils is zinc dialkyldithiophosphate (ZDDP). It is believed that ZDDP antiwear additives protect the engine by forming a protective film on metal surfaces. ZDDP may have a detrimental impact on fuel economy and efficiency and copper corrosion. Consequently, engine lubricants may also contain a friction modifier to obviate the detrimental impact of ZDDP on fuel economy and corrosion inhibitors to obviate the detrimental impact of ZDDP on copper corrosion.

Further, engine lubricants containing phosphorus compounds and sulphur have been shown to contribute in part to particulate emissions and emissions of other pollutants. In addition, sulphur and phosphorus tend to poison the catalysts used in catalytic converters, resulting in a reduction in performance of said catalysts.

With increasing control of both sulphated ash and release of emissions (typically to reduce NOx formation, SOx formation) there is a desire towards reduced amounts of sulphur, phosphorus and sulphated ash in engine oils. Consequently, the amounts of phosphorus-containing antiwear agents such as ZDDP, overbased detergents such as calcium or magnesium sulphonates and phenates have been reduced. As a consequence, ashless additives such as esters of polyhydric alcohols or hydroxyl containing acids including glycerol monooleate and alkoxylated amines have been contemplated to provide friction performance. However there have been observations that ashless friction modifiers may in some instances increase corrosion of metal, namely, copper or lead. Copper and lead corrosion may be from bearings and other metal engine components derived from alloys using copper or lead. Consequently, there is a need to reduce the amount of corrosion caused by ashless additives. However, reducing the levels of antiwear and other ash-containing additives may result in increasing amounts of wear and/or copper corrosion.

Various attempts have been made to reduce corrosion caused by ashless additives. These attempts include those disclosed in US Patent Application US 2004/038835; U.S. Pat. Nos. 3,966,623, 3,896,050, 4,012,408; and European publication EP 1 642 954.

US Patent Application US 2004/038835 discloses certain 1,2,4-triazole metal deactivators are especially non-aggressive towards lead engine parts such as bearings. The inclusion of certain 1,2,4-triazole compounds allows the co-use of corrosive additives such as sulfur-containing additives and vegetable oil-derived friction modifiers.

U.S. Pat. No. 3,966,623 discloses improved copper corrosion properties by employing a lubricant that contains a combination of an alkenyl or alkyl primary amine derivative salt of 2-mercaptobenzothiazole, and 2,5-bis -hydrocarbyldithio-1,3,4-thiadiazole. This combination is suitable for reduction of copper corrosion caused by additives with detergent, dispersancy, load carrying and lubricity functions These additives may be corrosive in themselves and/or break down during use into corrosive substances which result in severe corrosive attack.

U.S. Pat. Nos. 3,896,050 and 4,012,408 disclose the problem of copper corrosion caused by lubricant additives. The solution proposed in U.S. Pat. No. 3,896,050 is the use of a 5-bis(alkyldithio)-4-substituted isothiazole as a copper corrosion inhibitor.

EP 1 642 954 discloses a fluid composition comprising at least one hydroxy-substituted carboxylic acid. The at least one hydroxy-substituted carboxylic acid provides at least one property chosen from rust inhibition, corrosion inhibition, improved lubricity, and improved lead compatibility.

SUMMARY OF THE INVENTION

The inventors of this invention have discovered that a lubricating composition and method as disclosed herein is capable of providing acceptable levels of at least one of (i) phosphorus emissions (typically reducing or preventing emissions), (ii) sulphur emissions (typically reducing or preventing emissions), (iii) copper and/or lead corrosion inhibiting performance, and (iv) wear and/or extreme pressure performance (typically reducing or preventing).

In one embodiment the invention provides a lubricating composition comprising an oil of lubricating viscosity and a β-amino carbonyl compound of formula:

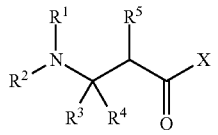

wherein, each variable

X may be —$OR^6$, —$HNR^6$, —$N(R^6)_2$;

$R^1$ and $R^2$ may be hydrogen, an unsubstituted or substituted hydrocarbyl group containing 1 to 30, or 1 to 10, or 1 to 5 carbon atoms, with the proviso that $R^1$ and $R^2$ are simultaneously not both hydrogen, wherein the hydrocarbyl group or substituted hydrocarbyl group may be any of (i) an acyl-substituted hydrocarbyl group with no primary amines, (ii) an optionally substituted alk(en)yl chain containing 1 to 30 carbon atoms;

(iii) an ether-substituted hydrocarbyl group containing 1 to 30 carbon atoms;

(iv) a hydroxy-alkyl group HO-Ak'-, wherein Ak'- is an alkylene group containing 1 to 30 carbon atoms;

$R^3$ and $R^4$ may be hydrogen, an unsubstituted or substituted hydrocarbyl group (typically an acyl or alk(en)yl group) containing 1 to 30 carbon atoms, or —C(O)—O-Ak, with the proviso that the number of total number of carbon atoms on substituent groups $R^1$, $R^2$, $R^3$, $R^4$, $R^5$ and $R^6$ is at least 8 (or at least 10, or at least 12, for example ranges of 8 to 50, or 8 to 40, or 10 to 30);

Ak may be an alk(en)yl group containing 1 to 30, or 4 to 30, or 6 to 16 carbon atoms;

$R^5$ may be hydrogen or an alkyl group containing 1 to 8, or 1 to 4, or 1 to 2 carbon atoms (typically $R^5$ may be hydrogen or methyl), or $R^1$ and $R^5$ are joined to form a cyclic structure; and $R^6$ may be an alk(en)yl chain containing 1 to 30, or 4 to 30, or 6 to 16 carbon atoms.

In one embodiment the $R^1$ and $R^5$ groups may be hydrocarbyl groups that are joined to form a cyclic structure. In one embodiment $R^1$ and $R^5$ groups may not be joined to form a cyclic structure.

In one embodiment the β-amino carbonyl compound may be present at 0.01 wt % to 10 wt %, or 0.05 to 5 wt %, 0.075 to 2, or 0.075 to 0.3 wt % of the lubricating composition.

In one embodiment invention provides for the use of the β-amino carbonyl compound as described herein as a copper corrosion inhibiting agent, friction control agent, antiwear and/or extreme pressure agent.

In one embodiment the invention provides for the use of the β-amino carbonyl compound disclosed herein as an engine oil corrosion inhibitor, friction control agent, antiwear and/or extreme pressure agent.

In one embodiment invention provides a lubricating composition comprising an oil of lubricating viscosity, an amide, ester or imide derivative of a hydroxy-carboxylic acid, and a β-amino carbonyl compound disclosed herein.

In one embodiment the lubricating composition contains (a) β-amino carbonyl compound present at 0.01 wt % to 10 wt %, or 0.05 to 5 wt %, or 0.075 to 0.3 wt % of the lubricating composition, and (b) an amide, ester or imide derivative of a hydroxy-carboxylic acid present at 0 wt % to 10 wt %, or 0.01 wt % to 10 wt %, or 0.1 to 5 wt %, or 0.075 to 0.3 wt % of the lubricating composition.

In one embodiment the lubricating composition may be further characterised as having at least one of (i) a sulphur content of 0.8 wt % or less, (ii) a phosphorus content of 0.2 wt % or less, or (iii) a sulphated ash content of 2 wt % or less.

In one embodiment the lubricating composition may be further characterised as having (i) a sulphur content of 0.5 wt % or less, (ii) a phosphorus content of 0.1 wt % or less, and (iii) a sulphated ash content of 1.5 wt % or less.

In one embodiment the lubricating composition further includes at least one of a friction modifier, a viscosity modifier, an antioxidant, an overbased detergent, a succinimide dispersant, or mixtures thereof.

In one embodiment the lubricating composition further includes a viscosity modifier and an overbased detergent.

In one embodiment the lubricating composition further includes an overbased detergent and a succinimide dispersant.

In one embodiment the invention provides a method for lubricating a mechanical device (typically, an engine oil) comprising supplying to the device a lubricating composition as disclosed herein.

DETAILED DESCRIPTION OF THE INVENTION

The present invention provides a lubricating composition and a method for lubricating an internal combustion engine as disclosed above.

β-Amino Compound

In one embodiment, the β-amino carbonyl compound may be represented by the formula:

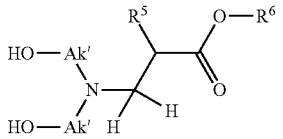

wherein each variable $R^5$ may be methyl or hydrogen;

$R^6$ may be an alk(en)yl chain containing 1 to 30, or 4 to 30, or 6 to 16 carbon atoms; and independently each Ak'- may be an alkylene group typically containing 1 to 30, or 1 to 10, or 1 to 5 carbon atoms.

In one embodiment the β-amino carbonyl compound may be represented by the formula:

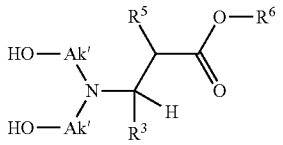

wherein, each variable $R^3$ may be a an unsubstituted or substituted hydrocarbyl group (typically an acyl or alk(en)yl group) containing 1 to 30, or 4 to 30, or 6 to 16 carbon atoms;

$R^5$ may be methyl or hydrogen;

$R^6$ may be an alk(en)yl chain containing 1 to 30, or 4 to 30, or 6 to 16 carbon atoms; and independently each Ak'- may be an alkylene group typically containing 1 to 30, or 1 to 10, or 1 to 5 carbon atoms.

In one embodiment the β-amino carbonyl compound may be represented by the formula:

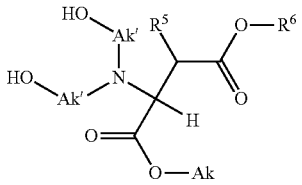

wherein, each variable

Ak may be an alk(en)yl group containing 1 to 30, or 4 to 30, or 6 to 16 carbon atoms;

$R^5$ may be methyl or hydrogen;

$R^6$ may be an alk(en)yl chain containing 1 to 30, or 4 to 30, or 6 to 16 carbon atoms; and independently each Ak'- may be an alkylene group typically containing 1 to 30, or 1 to 10, or 1 to 5 carbon atoms.

As used herein the term "(meth)acrylate" includes both acrylate and methacrylate. As used herein the term" alk(en)yl group" includes both alkyl and alkenyl.

The β-amino carbonyl compound may be obtained/obtainable by a process comprising a Michael-type addition reaction. This reaction may be described as a 1,4-conjugate addition of an amine to an ethylenically unsaturated material such as an olefin or a (meth)acrylate.

In one embodiment the 1,4-conjugate addition of the amine may be to an olefin, or mixtures thereof. In one embodiment the 1,4-conjugate addition of the amine may be to an acrylate, or mixtures thereof. In one embodiment the 1,4-conjugate addition of the amine may be to a methacrylate, or mixtures thereof. In one embodiment the 1,4-conjugate addition of the amine may be to a mixture of (i) an acrylate and (ii) a methacrylate.

In one embodiment the β-amino carbonyl compound contains 1 to 6, or 1 to 4, or 1 to 2 carbonyl groups. In one embodiment the β-amino carbonyl compound contains 1 carbonyl group. In one embodiment the β-amino carbonyl compound contains 2 carbonyl groups. When the β-amino carbonyl compound contains 2 carbonyl groups, the compound may be described as an a, β-amino dicarbonyl compound i.e., to α one carbonyl group and 0 to the second carbonyl group.

The general reaction involving the Michael-type addition of an amine with a (meth)acrylate is a known reaction. A more detailed discussion of the Michael addition is disclosed in March, Jerry. Advanced Organic Chemistry, 3rd ed. Wiley & Sons, 1985. p. 689.

The Michael-type addition reaction may be carried out at a temperature from 40° C. to 120° C., or 45° C. to 100° C.

The process allows for reaction in the presence of a single amine, and a single (meth)acrylate as well as mixtures of amines or mixtures of (meth)acrylates.

The amine may be a primary or a secondary amine. The amine may be an alkanolamine.

The alkanolamine may contain contains 1 to 6, or 1 to 3 hydroxy groups; and 1 to 8, or 1 to 2 amine groups. The alkanolamine may be a monoalkanolamine, a dialkanolamine, or mixtures thereof. The alkyl groups of the alkanolamine may contain 1 to 50, or 2 to 40, 2 to 25, or 2 to 15 carbon atoms.

Examples of a suitable alkanolamine include ethanolamine, isopropanolamine, diethanolamine, 3-amino-1,2-propanediol, serinol, 2-amino-2-methyl-1,3-propanediol, tris(hydroxymethyl)-aminomethane, 1-amino-1-deoxy-D-sorbitol, diethanol amine, diisopropanolamine, 2-amino-2-methyl-1-propanol, 2-dimethylamino-2-methyl-1,3-propanediol, 2-amino-2-ethyl-1,3-propanediol, 2-amino-2-methyl-1,3-propanediol, 2-amino-1-butanol, or mixtures thereof.

In one embodiment the alkanolamine may be diethanolamine, or mixtures thereof.

Examples of the (meth)acrylate include methyl methacrylate, butyl methacrylate, 2-methylpentyl, 2-propylheptyl, 2-butyloctyl, 2-ethylhexyl (meth)acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth)acrylate, pentadecyl (meth)acrylate, hexadecyl (meth)acrylate, 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl-(meth)acrylate, octadecyl (meth)acrylate, nonadecyl (meth)acrylate, eicosyl (meth)acrylate, 2-cetyleicosyl (meth)acrylate, 2-stearyleicosyl (meth)acrylate, docosyl (meth)acrylate and/or 2-eicosyltetratriacontyl (meth)acrylate; (meth) acrylates derived from unsaturated alcohols, such as oleyl (meth)acrylate; and cycloalkyl (meth)acrylates, such as 3-vinyl-2-butylcyclohexyl (meth)acrylate or bornyl (meth)acrylate.

In one embodiment the (meth)acrylate includes 2-methylpentyl, 2-propylheptyl, 2-butyloctyl, 2-ethylhexyl (meth) acrylate, octyl (meth)acrylate, nonyl (meth)acrylate, isooctyl (meth)acrylate, isononyl (meth)acrylate, 2-tert-butylheptyl (meth)acrylate, 3-isopropylheptyl (meth) acrylate, decyl (meth)acrylate, undecyl (meth)acrylate, 5-methylundecyl (meth) acrylate, dodecyl (meth)acrylate, 2-methyldodecyl (meth)acrylate, tridecyl (meth)-acrylate, 5-methyltridecyl (meth)acrylate, or mixtures thereof.

Amide, Ester or Imide Derivative of a Hydroxy-Carboxylic Acid

Optionally the lubricating composition of the invention further includes an amide, ester or imide derivative of a hydroxy-carboxylic acid, or mixtures thereof. In one embodiment the lubricating composition further includes an amide, ester or imide derivative of a hydroxy-carboxylic acid.

In one embodiment the amide, ester or imide derivative of a hydroxy-carboxylic acid may be at least one of a hydroxy-carboxylic acid di-ester, a hydroxy-carboxylic acid di-amide, a hydroxy-carboxylic acid di-imide, a hydroxy-carboxylic acid mono-imide, a hydroxy-carboxylic acid ester-amide, a hydroxy-carboxylic acid ester-imide, and a hydroxy-carboxylic acid imide-amide. In one embodiment the amide, ester or imide derivative of a hydroxy-carboxylic acid may be at least one of the group consisting of a hydroxy-carboxylic acid di-ester, a hydroxy-carboxylic acid di-amide, a hydroxy-carboxylic acid mono-imide, and a hydroxy-carboxylic acid ester-amide.

Examples of a suitable a hydroxycarboxylic acid include mandelic acid, citric acid, tartaric acid, lactic acid, glycolic acid, hydroxy-propionic acid, hydroxyglutaric acid, or mixtures thereof. In one embodiment the amide, ester or imide derivative of a hydroxy-carboxylic acid may be derived from tartaric acid, citric acid, hydroxy-succinic acid, dihydroxy mono-acids, mono-hydroxy diacids, or mixtures thereof. In one embodiment the amide, ester or imide derivative of a hydroxy-carboxylic acid includes derivatives of tartaric acid or citric acid. In one embodiment the amide, ester or imide derivative of a hydroxy-carboxylic acid may include a derivative of tartaric acid (such as a compound prepared from tartaric acid or a reactive equivalent, such as $C_1$-$C_7$ alkyl mono or diester of tartaric acid.

In one embodiment the derivatives of a hydroxy-carboxylic acid are either an ester or imide. The ester derivatives of a hydroxy-carboxylic acid may be tartrates or citrates (typically containing linear or branched alkyl groups each having 1 to 150, or 8 to 30, or 8 to 20 carbon atoms). The ester derivatives of the hydroxy-carboxylic acid may be formed by the reaction of an alcohol with hydroxy-carboxylic acid. The alcohol includes both monohydric alcohol and polyhydric alcohol (as a partial replacement of the monoalcohol). The carbon atoms of the alcohol may be linear chains, branched chains, or mixtures thereof.

Examples of a suitable branched alcohol include 2-ethylhexanol, isotridecanol, Guerbet alcohols, or mixtures thereof.

Examples of a monohydric alcohol include methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, or mixtures thereof. In one embodiment the monohydric alcohol contains 8 to 20 carbon atoms.

In one embodiment the imide derivatives of a hydroxy-carboxylic acid may be tartrimides, typically containing 8 to 20 carbon atoms.

US Patent Applications US 60/939,949 (filed May 24, 2007) and U.S. 60/939,952 (filed May 24, 2007) disclose in more detail useful hydroxycarboxylic acid compounds for the present invention.

Canadian Patent 1 183 125; US Patent Publication numbers 2006/0183647 and US-2006-0079413; U.S. PATENT Application No. 60/867,402; and British Patent 2 105 743 A, all disclose useful examples of suitable tartaric acid derivatives.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (typically hydrogenated) (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity includes an API Group I, Group II, Group III, Group IV, Group V oil or mixtures thereof. Often the oil of lubricating viscosity is an API Group I, Group II, Group III, Group IV oil or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein above is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

The composition optionally includes other performance additives. The other performance additives comprise at least one of metal deactivators, viscosity modifiers, detergents, friction modifiers, antiwear agents (other than the compounds of the present invention), corrosion inhibitors, dispersants, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition of the invention further includes at least one of a friction modifier, a viscosity modifier, an antioxidant, an overbased detergent, a succinimide dispersant, or mixtures thereof.

In one embodiment the lubricating composition of the invention further includes at least one of a viscosity modifier, an antioxidant, an overbased detergent, a succinimide dispersant, or mixtures thereof.

In one embodiment the lubricating composition comprising the β-amino carbonyl compound further includes a phosphorus-containing antiwear agent.

Detergents

In one embodiment the lubricating composition further includes known neutral or overbased detergents. Suitable detergent substrates include phenates, sulphur containing phenates, sulphonates, salixarates, salicylates, carboxylates, phosphates, mono- and/or di-thiophosphates, alkylphenols, sulphur coupled alkylphenol compounds, or saligenins. Various overbased detergents and their methods of preparation are described in greater detail in numerous patent publications, including WO2004/096957 and references cited therein. The detergent substrate may be salted with a metal such as calcium, magnesium, potassium, sodium, or mixtures thereof.

In one embodiment the overbased detergent is selected from the group consisting of phenates, sulphur containing phenates, sulphonates, salixarates, salicylates, and mixtures thereof. Typically the selected overbased detergent include calcium or magnesium phenates, sulphur containing phenates, sulphonates, salixarates, saliginens, salicylates, or mixtures thereof.

In one embodiment the detergent may be a calcium salicylate. In another embodiment the detergent may be a calcium sulphonate. In another embodiment the invention the detergent may be a mixture of a calcium sulphonate and a calcium salicylate.

In one embodiment the detergent may be a calcium phenate. In another embodiment the detergent may be a calcium sulphonate. In another embodiment the invention the detergent may be a mixture of a calcium sulphonate and a calcium phenate.

When the lubricating composition is not lubricating a 2-stroke marine diesel engine, the detergent may be present (on an oil free basis, i.e., an actives basis) at 0 wt % to 10 wt %, or 0.1 wt % to 8 wt %, or 1 wt % to 4 wt % of the lubricating composition. When the lubricating composition is lubricating a 2-stroke marine diesel engine the amount of detergent (on an oil free basis, i.e., an actives basis) may be 0 wt % to 40 wt %, or 2 wt % to 35 wt %, or 5 wt % to 30 wt % of the lubricating composition.

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterised by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with a polyisobutylene substituent having a number average molecular weight in the range 350 to 5000, or 500 to 3000. Succinimide dispersants and their preparation are disclosed, for instance in U.S. Pat. Nos. 3,172,892 or 4,234,435. Succinimide dispersants are typically the imide formed from a polyamine, typically a poly(ethyleneamine).

In one embodiment the invention further includes at least one dispersant which is a polyisobutylene succinimide derived from a polyisobutylene with number average molecular weight in the range 350 to 5000, or 500 to 3000. The polyisobutylene succinimide may be used alone or in combination with other dispersants.

In one embodiment the invention further includes at least one dispersant derived from polyisobutylene succinic anhydride, an amine and zinc oxide to form a polyisobutylene succinimide complex with zinc. The polyisobutylene succinimide complex with zinc may be used alone or in combination.

Another class of ashless dispersant includes Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present (on an oil free basis i.e., an actives basis) at 0 wt % to 20 wt %, or 0.1 wt % to 15 wt %, or 0.1 wt % to 10 wt %, or 1 wt % to 6 wt % of the lubricating composition.

Antioxidants

Antioxidant compounds are known and include for example, sulphurised olefins, alkylated diphenylamines (typically di-nonyl diphenylamine, octyl diphenylamine, di-octyl diphenylamine), hindered phenols, molybdenum compounds (such as molybdenum dithiocarbamates), or mixtures thereof. Antioxidant compounds may be used alone or in combination. The antioxidant may be present in ranges (on an oil free basis, i.e., an actives basis) of 0 wt % to 20 wt %, or 0.1 wt % to 10 wt %, or 1 wt % to 5 wt %, of the lubricating composition.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the lubricating composition further includes a molybdenum compound.

The molybdenum compound is selected from the group consisting of molybdenum dialkyldithiophosphates, molybdenum dithiocarbamates, amine salts of molybdenum compounds, and mixtures thereof.

Suitable examples of molybdenum dithiocarbamates which may be used as an antioxidant include commercial materials sold under the trade names such as Molyvan 822™ and Molyvan™ A from R. T. Vanderbilt Co., Ltd., and Adeka Sakura-Lube™ S-100, S-165 S-515, and S-600 from Asahi Denka Kogyo K. K and mixtures thereof.

When present, the molybdenum compound may provide 5 ppm to 1000 ppm, or 10 ppm to 750 ppm, or 20 ppm to 300 ppm, or 30 ppm to 250 ppm of molybdenum to the lubricating composition. When present, the molybdenum compound may provide 5 ppm to 300 ppm, or 20 ppm to 250 ppm of molybdenum to the lubricating composition.

Viscosity Modifiers

Viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, polyalkyl styrenes, hydrogenated alkenyl arene conjugated diene copolymers, polyolefins, esters of maleic anhydride-styrene copolymers.

Dispersant Viscosity Modifiers

Dispersant viscosity modifiers (often referred to as DVM), include functionalised polyolefins, for example, ethylene-propylene copolymers that have been functionalized with an acylating agent such as maleic anhydride and an amine; polymethacrylates functionalised with an amine, or esterified styrene-maleic anhydride copolymers reacted with an amine.

Antiwear Agents

In one embodiment the lubricating composition further includes at least one other antiwear agent other than the β-amino carbonyl compound described herein above.

The additional antiwear agent may be either ashless or ash-forming. Typically ashless antiwear agents do not contain metal, whereas ash-forming do contain metal.

The antiwear agent may be present (on an oil free basis, i.e., an actives basis) in ranges including 0 wt % to 15 wt %, or 0 wt % to 10 wt %, or 0.05 wt % to 5 wt %, or 0.1 wt % to 3 wt % of the lubricating composition.

In one embodiment the lubricating composition further includes a phosphorus-containing antiwear agent. Typically the phosphorus-containing antiwear agent may be present in an amount to deliver the ranges of phosphorus described below in the subject matter under the sub-heading "Industrial Application".

Examples of suitable antiwear agents include phosphate esters, sulphurised olefins, sulphur-containing anti-wear additives including metal dihydrocarbyldithiophosphates (such as primary or secondary zinc dialkyldithiophosphates, or molybdenum dialkyldithiophosphates), molybdenum thiocarbamate-containing compounds including thiocarbamate esters, alkylene-coupled thiocarbamates, and bis(S-alkyldithiocarbamyl) disulphides.

A person skilled in the art will appreciate that any zinc dialkyldithiophosphates may be capable of providing anti-wear performance. An example of one such dialkyldithiophosphate is disclosed in PCT Application U.S. Ser. No. 07/073,428 (entitled "Method of Lubricating an Internal Combustion Engine and Improving the Efficiency of the Emissions Control System of the Engine") or in PCT Application U.S. Ser. No. 07/073,426 (entitled "Lubricating Oil Composition and Method of Improving Efficiency of Emissions Control System"). Both applications claim priority from Jul. 17, 2006.

The dithiocarbamate-containing compounds may be prepared by reacting a dithiocarbamic acid or salt thereof with an unsaturated compound. The dithiocarbamate containing compounds may also be prepared by simultaneously reacting an amine, carbon disulphide and an unsaturated compound. Generally, the reaction occurs at a temperature of 25° C. to 125° C. U.S. Pat. Nos. 4,758,362 and 4,997,969 describe dithiocarbamate compounds and methods of making them.

Examples of suitable olefins that may be sulphurised to form the sulphurised olefin include propylene, butylene, isobutylene, pentene, hexene, heptene, octene, nonene, decene, undecene, dodecene, undecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulphurised olefin includes fatty acids and their esters. The fatty acids are often obtained from vegetable oil or animal oil and typically contain 4 to 22 carbon atoms. Examples of suitable fatty acids and their esters include triglycerides (such as soybean oil), oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. In one embodiment fatty acids and/or ester are mixed with olefins.

Extreme Pressure Agents

Extreme Pressure (EP) agents that are soluble in the oil include sulphur- and chlorosulphur-containing EP agents, chlorinated hydrocarbon EP agents and phosphorus EP agents. Examples of such EP agents include chlorinated wax; organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers

In one embodiment the further includes a friction modifier, or mixtures thereof. Typically the friction modifier may be present (on an oil free basis, i.e., an actives basis) in ranges including 0 wt % to 10 wt %, or 0.05 wt % to 8 wt %, or 0.1 wt % to 4 wt %.

Examples of suitable friction modifiers include long chain fatty acid derivatives of amines, esters, or epoxides; fatty imidazolines such as condensation products of carboxylic acids and polyalkylene-polyamines; amine salts of alkylphosphoric acids; fatty alkyl tartrates; fatty alkyl tartrimides; or fatty alkyl tartramides.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier is selected from the group consisting of long chain fatty acid derivatives of amines, esters, or epoxides; fatty alkyl tartrates; fatty alkyl tartrimides; and fatty alkyl tartramides. The fatty alkyl tartrates; fatty alkyl tartrimides; and fatty alkyl tartramides may be the same or different to the amide, ester or imide derivative of a hydroxy-carboxylic acid described above.

In one embodiment the friction modifier may be a long chain fatty acid ester (previously described above as an ashless antiwear agent). In another embodiment the long chain fatty acid ester may be a mono-ester and in another embodiment the long chain fatty acid ester may be a (tri)glyceride.

Other Additives

Other performance additives such as corrosion inhibitors include those described in paragraphs 5 to 8 of US Application U.S. Ser. No. 05/038,319 (filed on Oct. 25, 2004 McAtee and Boyer as named inventors), octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor is typically a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful.

Pour point depressants that may be useful in the compositions of the invention include polyalphaolefins, esters of maleic anhydride-styrene, poly(meth)acrylates, polyacrylates or polyacrylamides.

INDUSTRIAL APPLICATION

The lubricant may be used to lubricate a mechanical device, which, in one embodiment, is an internal combustion engine.

In one embodiment the internal combustion engine may be a diesel fueled engine, a gasoline fueled engine, a natural gas fueled engine or a mixed gasoline/alcohol fueled engine. In one embodiment the internal combustion engine may be a diesel fueled engine and in another embodiment a gasoline fueled engine.

The internal combustion engine may be a 2-stroke or 4-stroke engine. Suitable internal combustion engines include marine diesel engines, aviation piston engines, low-load diesel engines, and automobile and truck engines.

As used herein the components of the internal combustion engine include all of the parts of the engine derived from metal lubricated by an engine lubricant. This includes, for example, cylinder liners, camshafts, and piston heads.

In one embodiment the internal combustion engine contains components ferric components. The ferric components include metallic iron or steel, FeO, $Fe_3O_4$ or other materials containing iron.

In one embodiment the internal combustion engine contains components of an aluminium-alloy. The aluminium-alloy includes aluminium silicates, aluminium oxides, or other ceramic materials. In one embodiment the aluminium-alloy is an aluminium-silicate surface.

The lubricating composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 200 ppm to 600 ppm. The total sulphated ash content may be 2 wt % or less, or 1.5 wt % or less, or 1.1 wt % or less, or 1 wt % or less, or 0.8 wt % or less, or 0.5 wt % or less. In one embodiment the sulphated ash content may be 0.05 wt % to 0.9 wt %, or 0.1 wt % to 0.2 wt % or to 0.45 wt %.

In one embodiment the lubricating composition is an engine oil, wherein the lubricating composition may be characterised as having (i) a sulphur content of 0.5 wt % or less, (ii) a phosphorus content of 0.07 wt % or less, and (iii) a sulphated ash content of 1.5 wt % or less.

In one embodiment the lubricating composition may be suitable for a 2-stroke or a 4-stroke marine diesel internal combustion engine. In one embodiment the marine diesel combustion engine is a 2-stroke engine.

The following examples provide illustrations of the invention. These examples are non-exhaustive and are not intended to limit the scope of the invention.

EXAMPLES

Preparative Example 1 (Prep1) is the synthesis of 3-[bis-(2--hydroxy -ethyl)-amino]-propionic acid 2-ethyl-hexyl ester. A one-liter four-necked round bottom flask equipped with an overhead stirrer, sub-surface gas inlet tube, addition funnel, thermowell and Friedrichs condenser is charged with diethanolamine (150 g, 1.43 mol) and purged with nitrogen. The amine is warmed to 50° C. with stirring. The addition funnel is charged with 2-ethylhexyl acrylate (263 g, 1.43 mol) and the material is added drop-wise sub-surface over 1.5 hours. The rate of addition is adjusted to keep the exotherm below 55° C. The preparation is warmed to 85° C. and stirred for 3 hours, then heated to 95° C. and stirred for another 1.5 hours. The product is cooled to yield a clear liquid (409.8 g).

Preparative Example 2 (Prep2) is the synthesis of 2-[bis-(2-hydroxy -ethyl)-amino]-succinic acid bis-(2-ethyl-hexyl) ester. A one-liter four-necked round bottom flask equipped with an overhead stirrer, sub-surface gas inlet tube, addition funnel, thermowell and Friedrichs condenser is charged with diethanolamine (100 g, 0.95 mol) and purged with nitrogen. The amine is warmed to 50° C. with stirring. The addition funnel is charged with di-(2-ethylhexyl) maleate (317.5 g, 0.93 mol) and the material is added drop-wise sub-surface over 2.5 hours. The rate of addition is adjusted to keep the exotherm below 55° C. The preparation is warmed to 95° C. for 30 minutes then to 110° C. for 30 minutes. The material is then heated to 140° C. and stirred for 4 hours and followed by heating to 155° C. and stirred for 1 hour. The product is cooled to yield a clear liquid (411.9 g).

Lubricating Compositions

Comparative Lubricant 1 (CL1): is a lubricating composition designed for a fully formulated 5W-30 passenger car. The lubricating composition is prepared containing typical amounts of additives such as succinimide dispersant, over-based detergents, and zinc dialkyldithiophosphate. The lubricant also contains 0.4 wt % of a dialkyl tartrate.

Lubricant Example 1 (LE1): is a 5W-30 lubricant similar to CL1, except it does not contain the dialkyl tartrate. Further LE1 contains 0.4 wt % of the product of Prep1.

Lubricant Example 2 (LE2): is a 5W-30 lubricant similar to CL1, except it does not contain the dialkyl tartrate. Further LE2 contains 0.4 wt % of the product of Prep2.

Lubricant Example 3 (LE3): is a 5W-30 lubricant similar to CL1, except it contains 0.2 wt % of the dialkyl tartrate. Further LE3 contains 0.2 wt % of the product of Prep1.

Lubricant Example 4 (LE4): is a 5W-30 lubricant similar to CL1, except it contains 0.2 wt % of the dialkyl tartrate. Further LE4 contains 0.2 wt % of the product of Prep2.

Test 1: Copper Corrosion Test

The lubricants described above (LE1 to LE4 and CL1) are evaluated in copper corrosion test as defined in ASTM Method D6594-06. In general terms the test exposes each lubricant to a copper coupon under thermally and oxidatively stressed conditions. The amount of copper in the oils at the end of test is measured and compared to the amount at the beginning of the test. Lower copper content in the oil indicates decreased copper corrosion. Overall the results obtained for each lubricant are as follows:

| | CL1 | LE1 | LE2 | LE3 | LE4 |
|---|---|---|---|---|---|
| mg of Copper Obtained | 63 | 31 | 23 | 18 | 29 |

Overall the results indicate that the β-amino carbonyl compound of the invention provides copper corrosion inhibition.

It is known that some of the materials described above may interact in the final formulation, so that the components of the final formulation may be different from those that are initially added. The products formed thereby, including the products formed upon employing lubricating composition of the present invention in its intended use, may not be susceptible of easy description. Nevertheless, all such modifications and reaction products are included within the scope of the present invention; the present invention encompasses lubricating composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements. Multiple groups represented by the same symbol in the formulae described above, may be the same or different.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms, and encompass substituents such as pyridyl, furyl, thienyl and imidazolyl; and (iv) heteroatoms, including sulphur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and a β-amino carbonyl compound of formula:

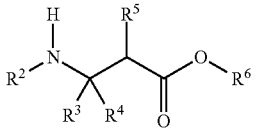

wherein, independently, each variable $R^2$ is an optionally substituted alk(en)yl chain containing 1 to 30 carbon atoms;

$R^3$ and $R^4$ are hydrogen, an unsubstituted or substituted hydrocarbyl group containing 1 to 30 carbon atoms, or —C(O)—O—Ak, with the proviso that the number of total number of carbon atoms on substituent groups $R^2$, $R^3$, $R^4$, $R^5$, and $R^6$ is at least 8;

$R^5$ is hydrogen or an alkyl group containing 1 to 8 carbon atoms;

Ak is an alk(en)yl group containing 1 to 30 carbon atoms; and $R^6$ is an alk(en)yl chain containing 4 to 16 carbon atoms.

2. The lubricating composition of claim 1 further comprising an amide, ester or imide derivative of a hydroxy-carboxylic acid, or mixtures thereof.

3. The lubricating composition of claim 2, wherein the amide, ester or imide derivative of a hydroxy-carboxylic acid is a derivative of tartaric acid or citric acid.

4. The lubricating composition of claim 3, wherein the amide, ester or imide derivative of a hydroxy-carboxylic acid is a derivative of tartaric acid.

5. The lubricating composition of claim 2, wherein the β-amino carbonyl compound is present at 0.05 to 5 wt % of the lubricating composition, and (b) the amide, ester or imide derivative of a hydroxy-carboxylic acid is present at 0.05 to 5 wt % of the lubricating composition.

6. The lubricating composition of claim 2, wherein the β-amino carbonyl compound is present at 0.075 to 0.3 wt % of the lubricating composition, and (b) the amide, ester or imide derivative of a hydroxy-carboxylic acid is present at 0.075 to 0.3 wt % of the lubricating composition.

7. The lubricating composition of claim 1, wherein the lubricating composition is further characterised as having at least one of (i) a sulphur content of 0.8 wt % or less, (ii) a phosphorus content of 0.2 wt % or less, or (iii) a sulphated ash content of 2 wt % or less.

8. The lubricating composition of claim 1, wherein the lubricating composition is characterised as having (i) a sulphur content of 0.5 wt % or less, (ii) a phosphorus content of 0.1 wt % or less, and (iii) a sulphated ash content of 1.5 wt % or less.

9. The lubricating composition of claim 1 further comprising at least one of a friction modifier, a viscosity modifier, an antioxidant, an overbased detergent, a succinimide dispersant, or mixtures thereof.

10. The lubricating composition of claim 9, wherein the friction modifier is selected from the group consisting of long chain fatty acid derivatives of amines, esters, or epoxides; fatty imidazolines; amine salts of alkylphosphoric acids; fatty alkyl tartrates; fatty alkyl tartrimides; and fatty alkyl tartramides.

11. The lubricating composition of claim 1 further comprising a phosphorus-containing antiwear agent.

12. The lubricating composition of claim 1 further comprising a molybdenum compound.

13. The lubricating composition of claim 12, wherein the molybdenum compound is selected from the group consisting of molybdenum dialkyldithiophosphates, molybdenum dithiocarbamates, amine salts of molybdenum compounds, and mixtures thereof.

14. The lubricating composition of claim 13, wherein the molybdenum compound provides 5 ppm to 300 ppm of molybdenum.

15. The lubricating composition of claim 1 further comprising an over-based detergent.

16. The lubricating composition of claim 15, wherein the overbased detergent is selected from the group consisting of phenates, sulphur containing phenates, sulphonates, salixarates, salicylates, and mixtures thereof.

17. A method for lubricating an engine oil comprising supplying to the engine a lubricating composition of claim 1.

18. The lubricating composition of claim 1 wherein $R^2$ is an unsubstituted alk(en)yl chain.

* * * * *